US011293721B2

(12) United States Patent
Ding et al.

(10) Patent No.: US 11,293,721 B2
(45) Date of Patent: Apr. 5, 2022

(54) SCOPE MOUNT ASSEMBLY WITH INTEGRAL LEVELER

(71) Applicant: Leapers, Inc., Livonia, MI (US)

(72) Inventors: Tai-lai Ding, Northville, MI (US); Tat Shing Yu, Plymouth, MI (US)

(73) Assignee: Leapers, Inc., Livonia, MI (US)

( * ) Notice: Subject to any disclaimer, the term of this patent is extended or adjusted under 35 U.S.C. 154(b) by 14 days.

(21) Appl. No.: 17/009,492

(22) Filed: Sep. 1, 2020

(65) Prior Publication Data

US 2022/0065584 A1 Mar. 3, 2022

(51) Int. Cl.

| | |
|---|---|
| ***F41G 1/44*** | (2006.01) |
| ***F41G 11/00*** | (2006.01) |
| *F41G 1/467* | (2006.01) |

(52) U.S. Cl.

CPC ..... *F41G 1/44* (2013.01); *F41G 11/003* (2013.01); *F41G 1/467* (2013.01)

(58) Field of Classification Search

CPC ..... F41G 1/44; F41G 11/001
USPC ..... 42/111
See application file for complete search history.

(56) References Cited

U.S. PATENT DOCUMENTS

| | | | | |
|---|---|---|---|---|
| 9,015,982 | B1 | 4/2015 | Powers | |
| 2021/0180916 | A1* | 6/2021 | Lindsay | G01C 9/34 |

OTHER PUBLICATIONS https://www.brownells.com/optics-mounting/optic-accessories/scope-anti-cant-devices/top-ring-bubble-level-30mm-4-screw-sku749012034-41177-77276.aspx?cm_mmc=cse-_-ltwine-_-shopzilla-_-749-012-034&utm_medium=cse&utm_source=connexity&utm_campaign=itwine&utm_content=749-012-034, downloaded Aug. 25, 2020.

https:/www.amazon.com/Wheeler-Anti-Cant-Indicator-30mm/dp/B008YLR34S, downloaded Aug. 25, 2020.

https://www.aliexpress.com/item/32694348960.html, downloaded Aug. 25, 2020.

https://outdoors.natchezss.com/bestsellers/Scope-Level, downloaded Aug. 25, 2020.

* cited by examiner

*Primary Examiner* — Reginald S Tillman, Jr.

(74) *Attorney, Agent, or Firm* — Warner Norcross + Judd LLP

(57) ABSTRACT

A scope mount assembly is provided including a scope mount having a reference axis and a level indicator rotatably joined with the scope mount. The level indicator can be rotatable from a stored mode, where a level indicator axis is transverse to the reference axis, to an extended mode, where the level indicator axis is transverse to the reference axis, and the level indicator projects laterally away from the reference axis. The assembly can include a first magnet that magnetically secures the level indicator in the stored mode, and a second magnet that magnetically secures the level indicator in the extended mode. A user rearward of the mount can view the laterally extending level indicator when the level indicator is in the extended mode, and optionally when the level indicator is in the stored mode, to confirm the level of the scope and any weapon to which it is mounted.

19 Claims, 6 Drawing Sheets

SCOPE MOUNT ASSEMBLY WITH INTEGRAL LEVELER

BACKGROUND OF THE INVENTION

The present invention relates to firearms, and more particularly to a scope mount having an integral leveler for use with a firearm.

Many modern sporting, military and hunting firearms are mounted with optics, such as a scope or other magnifying device, to improve viewing and alignment of the firearm with an intended target. Scopes usually include indicia, such as a reticle, crosshairs or other markings viewed by a user through the scope when acquiring a target, to assist in aligning the indicia with the target. The mounting of a scope on a firearm typically should be precise and accurate so that the bullet follows generally along an intended trajectory. Typically, scope rings are used to mount scopes precisely and in a secured, fixed position relative to the firearm.

Most scopes are used to magnify distant targets in long range shooting activities. In such activities, vertical alignment of a firearm barrel and a scope indicia, such as a reticle, is important to avoid unnecessary cant of the firearm. Cant occurs when the firearm barrel and reticle are not aligned in a vertical plane, one above the other. In a situation where the firearm is canted, the cant typically results in the fired projectile impacting to either one side or the other of a target, particularly as target range changes. The amount of undesired side travel of a projectile can increase with an increase in both range distance and cant angle. This undesired side travel of the fired projectile ultimately can result in inaccurate shooting, where the projectile fails to, or inadequately engages, a target.

To address cant, some manufacturers offer bubble level devices rigidly secured to a scope or its mounts. These bubble levels are configured so that a user can view the bubble, ensure it registers as horizontally level, and confirm that the firearm barrel and sight indicia are not canted from a corresponding vertical orientation, that is, when these elements lay outside a vertical plane. While such bubble level devices can assist in diminishing cant, they can be cumbersome, can be complicated to operate, and prone to damage, particularly where the firearm and scope are used in harsh environments.

Accordingly, there remains room for improvement in the field of mounting assemblies, and in particular, the way that levels are incorporated into the same for safe storage, easy access and/or secure deployment.

SUMMARY OF THE INVENTION

A scope mounting assembly is provided, and can include a scope mount having a reference axis and a level indicator rotatably joined with the scope mount. The level indicator can be rotatable from a stored mode, where a level indicator axis is transverse to the reference axis and in a secure location, to an extended mode, where the level indicator axis is transverse to the reference axis, and the level indicator projects laterally away from the reference axis.

In one embodiment, the assembly can include a first magnet that magnetically secures the level indicator in the stored mode, and a second magnet that magnetically secures the level indicator in the extended mode. A user rearward of the mount can view the laterally extending level indicator when the level indicator is in the extended mode, to confirm the level of the scope and any weapon to which it is mounted.

In another embodiment, the scope mounting assembly can include a rail disposed above the level indicator and joined with the scope mount. The rail can include multiple slots and an elevated platform above the mount. A secondary optic, such as a reflex or red dot sight can be mounted atop the rail, which in some cases can be a picatinny style rail, in accordance with MIL-STD-1913 (AR) 3 Feb. 1995, which is hereby incorporated by reference in its entirety.

In still another embodiment, the scope mount can include an upright wall extending between the scope mount and the rail. A mount recess can be bounded by the scope mount, the rail and/or the upright wall. The level indicator can be disposed in the mount recess when the level indicator is in the stored mode. The level indicator can be pivoted or otherwise removed from the mount recess to the extended mode, in which the level indicator is disposed outside the mount recess.

In yet another embodiment, the scope mount can be an upper ring cap, which sits atop or over a portion of a scope that is secured to a weapon via the mounting assembly. The scope ring cap can include fastener holes that allow the scope ring cap to be fastened or otherwise secured to a scope base, which can be further secured to a rail or fixation element mounted to the weapon.

In even another embodiment, the level indicator can include a free end that is disposed in the mount recess when the level indicator is in the stored mode. The free end can be adjacent a first side of the scope mount when the level indicator is in the stored mode. The free end also can be located on a first side of the reference axis in the stored mode. The free end can be distal from the first side and can project away from a second side, opposite the first side, when the level indicator is in the extended mode. The free end can be located on a second side of the reference axis, opposite the first side, when the level indicator is in the extended mode.

In a further embodiment, the level indicator can include a first magnet joined with the scope mount, a second magnet joined with the scope mount distal from the first magnet, a third magnet joined with a free end of the level indicator, and a fourth magnet joined with a fixed end of the level indicator. In still a further embodiment, the third magnet and first magnet can be magnetically urged toward one another to magnetically secure the level indicator in the stored mode. The fourth magnet and the second magnet can be magnetically urged toward one another to magnetically secure the level indicator in the extended mode.

In still yet a further embodiment, the magnet system of the scope mounting assembly can be configured to hold the level indicator in the extended mode under recoil from the weapon, optionally where the recoil is greater than 5 foot pounds.

The current embodiments of the scope mounting assembly provide a levelling mechanism to reduce or eliminate cant in a weapon that previously have been unachievable. For example, where the scope mounting assembly includes the fold-out features, it allows the user to store the level indicator securely in a stowed position, as well as selectively extend it to a more extended, more visible position. Where the scope mounting assembly includes the integral rail, that rail can accommodate an additional modular option to secure another reflex optic or a secondary sight to the scope held by the scope mounting assembly. The position of that additional sight can be well aligned with the scope to aid in quick target acquisition and interchangeable use of either the scope or the additional sight, all while using the level indicator. Where the level indicator is integral with a scope mount, such as a scope cap, a user can ensure rail alignment during the ring cap assembly as well. Where the level indicator is stored and extended via the magnetic force of magnets, those magnets can be spaced and oriented relative to one another in a manner to withstand a variety or recoils from a variety of different types of weapons.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

A current embodiment of the mounting assembly is illustrated in FIGS. 1-6 and generally designated 10. The mounting assembly as shown in the figures can be configured to attach a scope 101 to a receiver or frame 102 of a weapon 102. As used herein, scope can refer to a rifle scope, with or without magnification, a red dot scope, a reflex sight, a holographic sight or any other type of sight having indicia that is beneficial to have leveled relative to the horizon or a reference plane to impair, reduce or prevent cant of the weapon and/or scope. The weapon as shown can be a firearm, such as a rifle, pistol, handgun, shotgun of any type, or an archery device such as a compound bow or crossbow, or other projectile shooting device such as a rocket propelled grenade launcher, a ground-to-air missile launcher, or other device.

Figure 1:
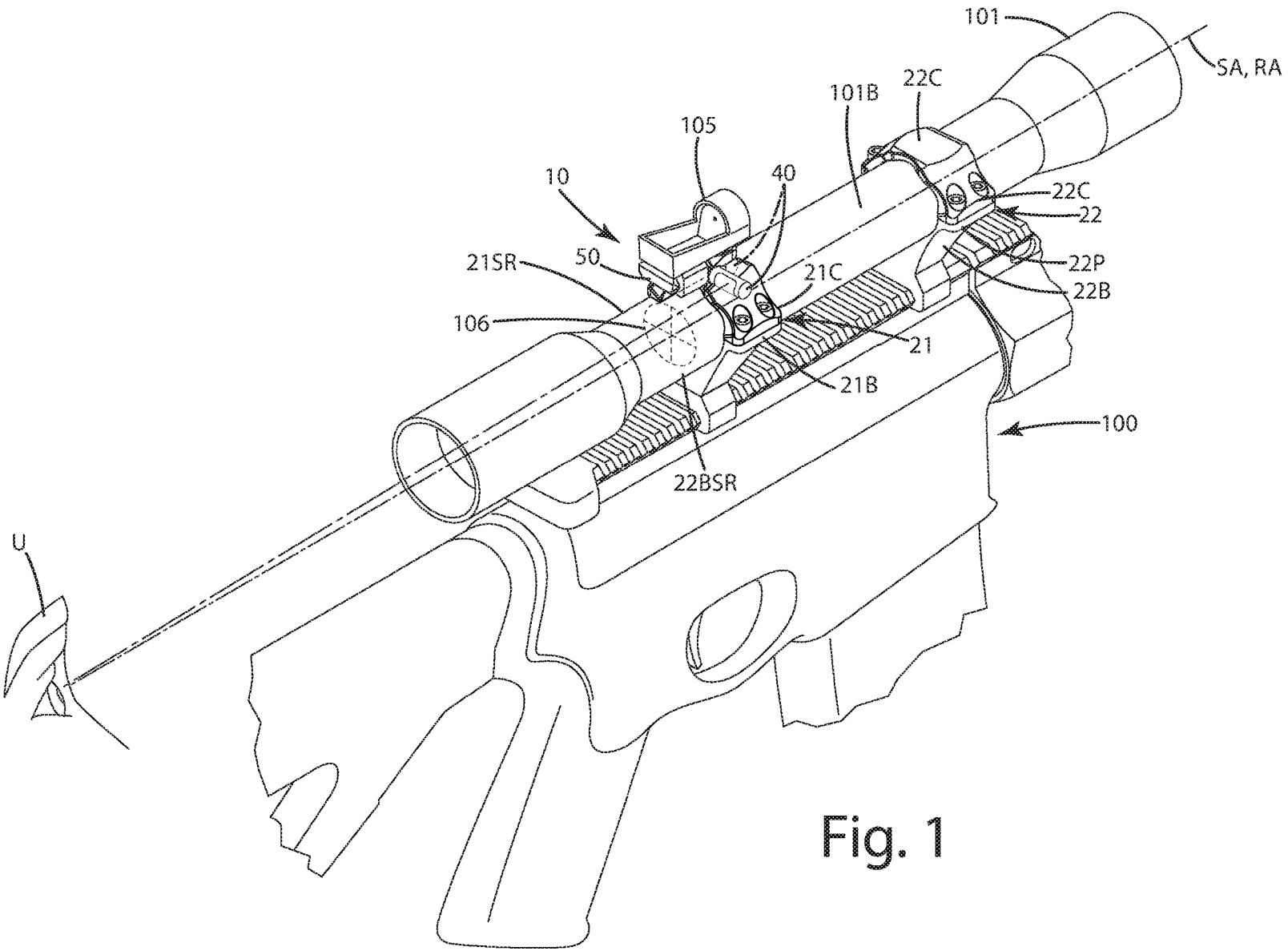
FIG. 1 is a perspective view of a scope mounting assembly of a current embodiment on a scope on a weapon, showing a level indicator in a stored mode in solid lines and an extended mode in broken lines.

As shown in FIG. 1, the scope mounting assembly can include first 21 and second 22 scope mounts that engage a scope 101 at the barrel 101B of the scope. The second scope mount 22 can include a base 22B and a scope cap 22C. The base 22B can include a clamp 22BC that clamps to a picatinny rail of the firearm as shown, or any other rail or mounting portion of the weapon, which can vary depending on the application. The cap and base can form a round or circular opening through which the barrel 101B, which can be cylindrical, fits and is nested. The base and cap can be secured to one another with fasteners 22P that extend through the cap and base 22C and 22B. When tightened, the fasteners cause the cap and base to clamp together, around the scope and in particular the barrel, securing it longitudinally relative to the weapon and rotationally about a longitudinal scope axis SA. As described below, this scope axis SA can correspond to a reference axis RA of the first scope mount 21.

Figure 2:
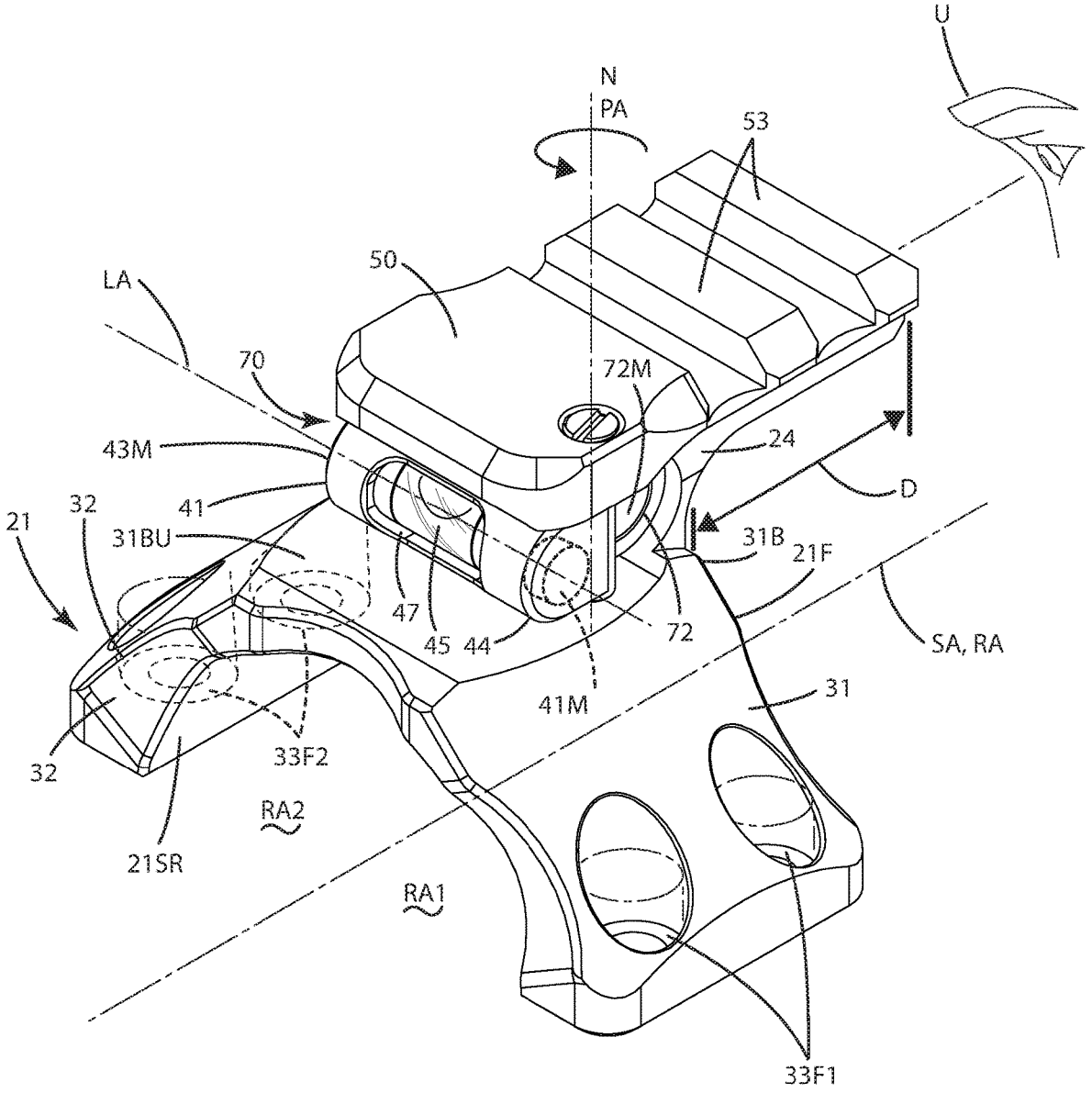
FIG. 2 is a close up front perspective view of the scope mount with the level indicator in the stored mode.

Turning now to the first scope mount 21 shown in FIGS. 1 and 2, that can be disposed or spaced a distance from the second scope mount 22. The distance can vary depending on the scope and the application and method of securing the scope to the weapon 100. The first scope mount 21, referred to below generally as the scope mount, can be configured to extend adjacent and secure a scope to a weapon. The scope mount 21 can include a downwardly opening curved scope recess 21SR sized to accommodate the scope 100. The downwardly opening recess can be matched and opposed to an upwardly opening curved recess 21BSR of a scope mount base 21B. The recess 21SR can be cylindrical as shown to engage a cylindrical barrel of a scope. Of course, the recess shape can vary depending on the shape of the barrel or other portion of a scope which the scope mount engages. The scope mount can include a reference axis RA as mentioned above, which can correspond to a scope longitudinal axis SA when the mount is installed relative to the scope. The reference axis RA can extend forwardly and rearwardly, and can be parallel to and above a barrel axis of a barrel of the weapon when fully installed. The reference axis RA can bisect the scope mounting assembly 10 into a first side RA1 and a second side RA2.

Figure 4:
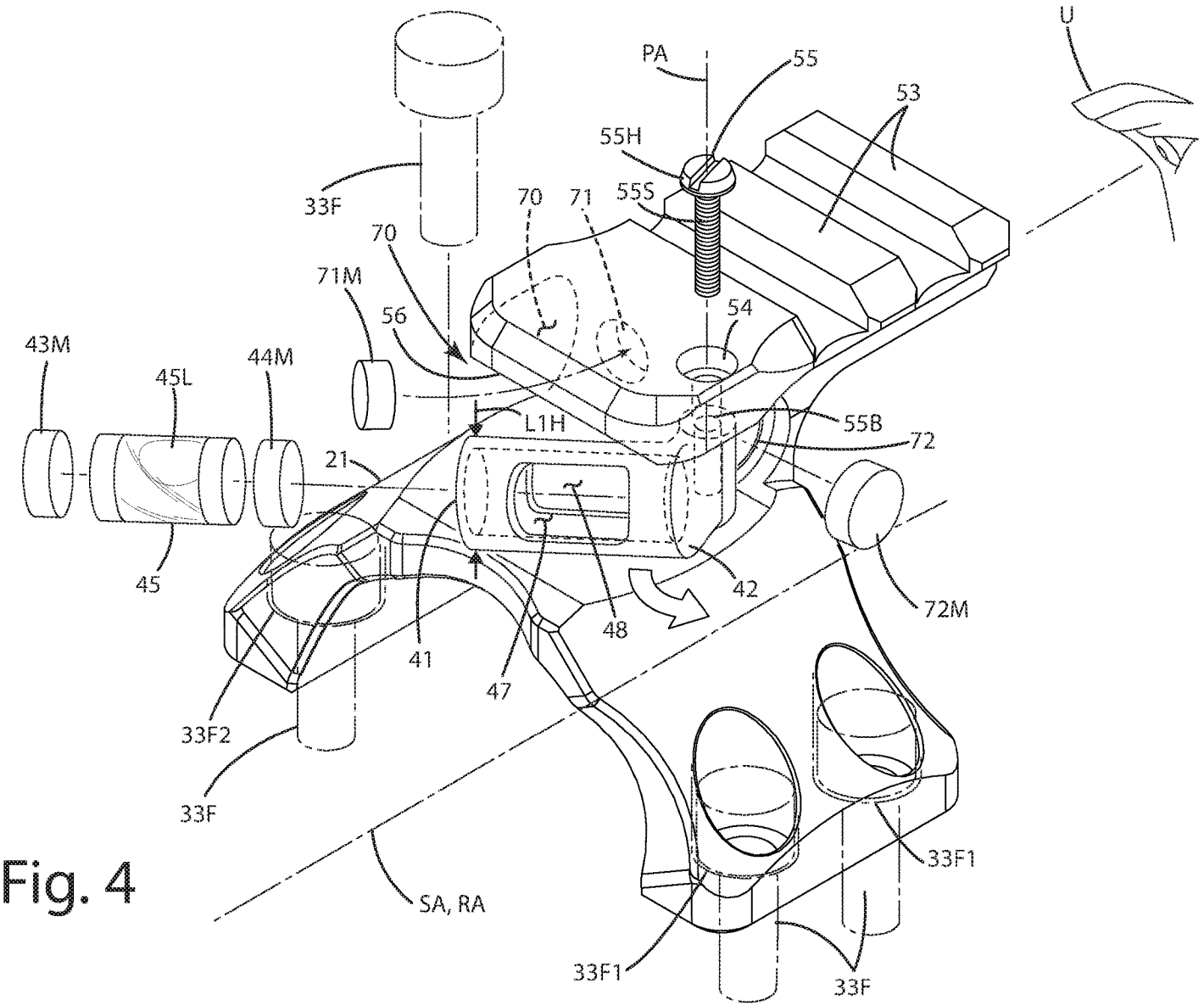
FIG. 4 is a close up front perspective view of the scope mount being transitioned between a stored mode and an extended mode.

The scope mount 21 as shown in FIGS. 2 and 4 can include a first lateral side 31 and a second lateral side 32. The first lateral side 31 can transition to a bridge 31B that extends over the scope recess 21SR. The bridge 31B can include an upper surface 31BU. The bridge 31B can transition to the second lateral side 32 on the opposite side RA2 of the reference axis RA. The upper surface 31BU can be generally planar as shown, or can include a curved or angled contour depending on the application. The bridge 31B also can include a lower surface or underside. That lower surface can engage or can be placed adjacent or near the scope when mounted thereon. Optionally, as shown, the scope mount 21 can be a scope ring cap, but can also be other parts of a scope mounting assembly, such as a scope base or other element of the assembly, depending on the application.

Figure 3:
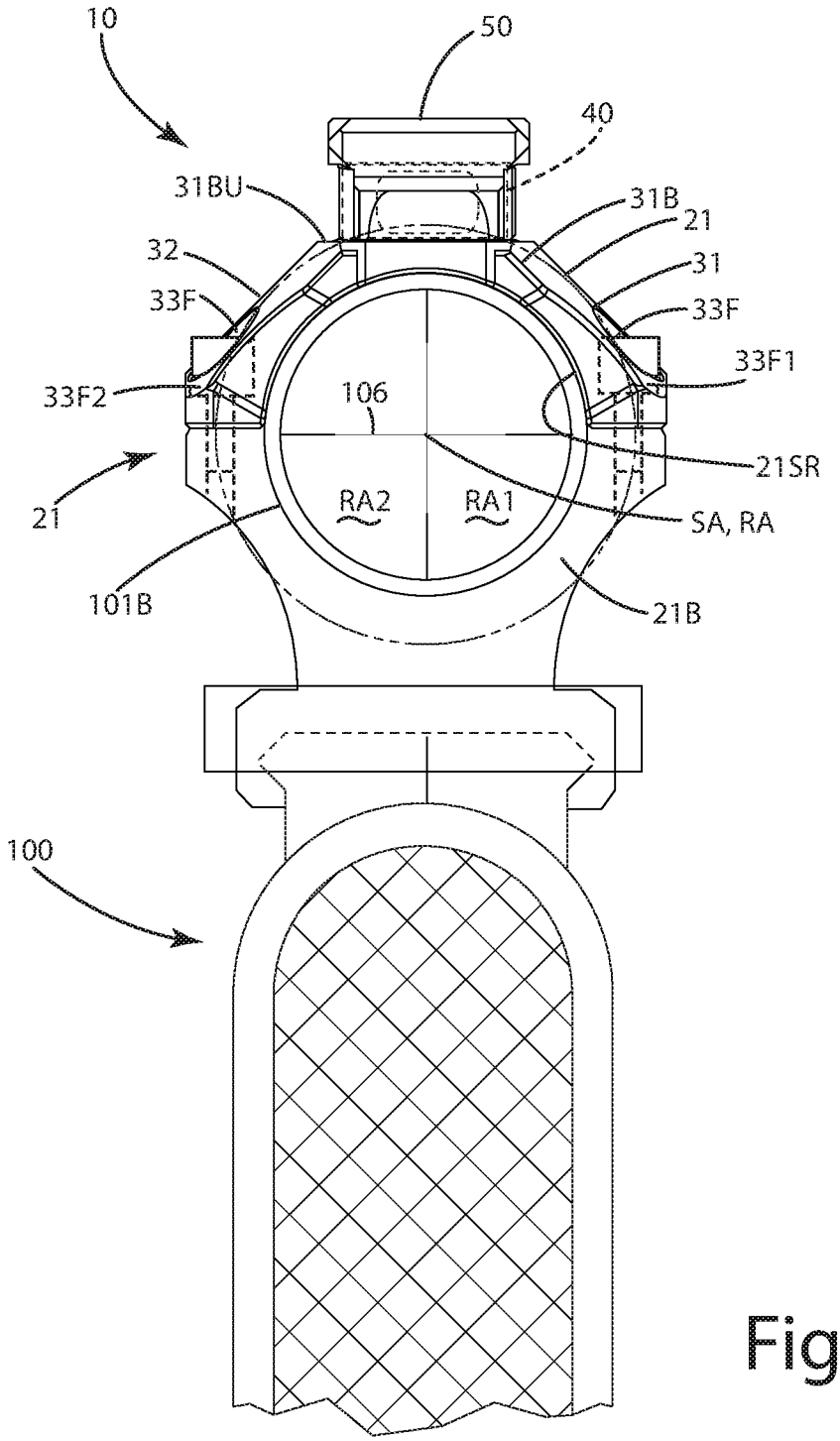
FIG. 3 is a rear view of the mounting assembly on a scope on a weapon in the stored mode.

With reference to FIGS. 1-3, the scope mount 21 can include one or more first fastener holes 33F1 and second fastener holes 33F2 on opposing sides RA1 and RA2 of the reference axis RA, and generally on opposing sides of the scope recess 21SR. These fastener holes can align with corresponding fastener holes in a corresponding base 21B of the scope mount. Although shown with two fastener holes on each side of the reference axis RA, fewer or more holes can be included. The fastener holes can receive corresponding fasteners 33F, and those fasteners 33F can thread into the threaded holes of the base 21B. The fasteners can be tightened, and in so doing, can urge the mount 21C toward the base 21B to capture and optionally clamp the scope between those components.

The scope mount 21 also can include an upright wall 24 extending upward from the upper surface 31BU of the bridge 31B. The wall can extend upward at least a height LIH of a level indicator 40 as described below. The wall 24 can have a rail 50 mounted atop the upright wall and above the scope mount. The rail 50 can extend forward of a front 21F of the mount a distance D which can be sufficient to attach a secondary sight 105 to the upper portion of the scope mount. The rail can be a picatinny rail including one or more slots 53 that allow screws, pins or rods to be placed transversely relative to the rail to secure devices to the rail. The rail can include a first end 51 and an opposing second end 52. The first end can extend rearward of the upright wall 24 in a cantilevered manner, and the second end 52 can extend forward of the upright wall 24 in a cantilevered manner, and optionally forward of the front 21F of the scope mount 21. The rail can optionally be a picatinny style rail, in accordance with MIL-STD-1913 (AR) 3 Feb. 1995. The rail 50 can define a fastener hole 54 extending from a rail upper surface 55 to a rail lower surface 56. This fastener hole 54 can receive a pivot fastener, pin, shaft or axle 55, about which a level indicator 40 can rotate as described below. The fastener hole can include a tapered upper hole portion to receive a tapered head 55H of the pin 55 as shown in FIG. 4. The shaft 55S of the pin or screw can extend below the tapered or other head.

Figure 5:
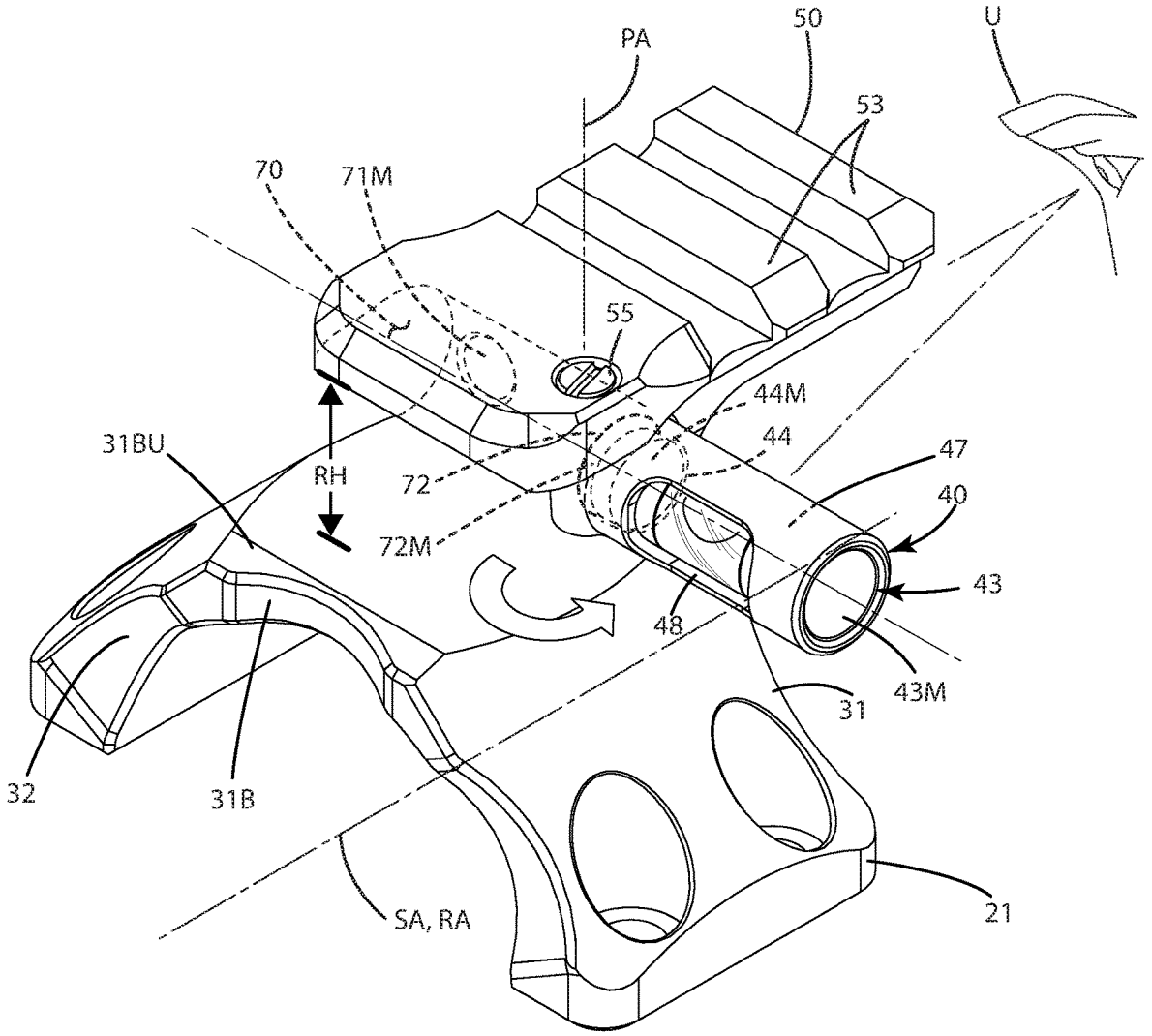
FIG. 5 is a close up front perspective view of the scope mount with the level indicator in the extended mode.

The scope mount 21 shown in FIGS. 1-3 optionally can define a mount recess 70. This mount recess 70 can be configured to receive at least a portion of the level indicator 40. The recess can be defined by at least a portion of the rail 50 and the wall 24. In particular, the recess 70 can be defined between the rail lower surface 56 and the bridge upper surface 31BU, with the wall 24 disposed forward of the recess. The recess can be configured to have a height RH that is greater than the level indicator height LIH, as shown in FIG. 5. The mount recess 70 can include a mount recess axis MA that is transverse, for example perpendicular, to the reference axis RA. The mount recess 70 can extend toward an optional secondary recess 72 that is generally transverse to the mount recess 70. The mount recess 70 can generally contain, house and/or conceal a portion of the level indicator 40 in the stored mode. The level indicator in this stored mode, shown in FIGS. 2 and 3, however can be removed from, distal from or generally located outside the secondary recess 72. The mount recess can extend the width of the rail and/or the width of the upper surface 31BU of the bridge 31B of the scope mount 21.

Figure 6:
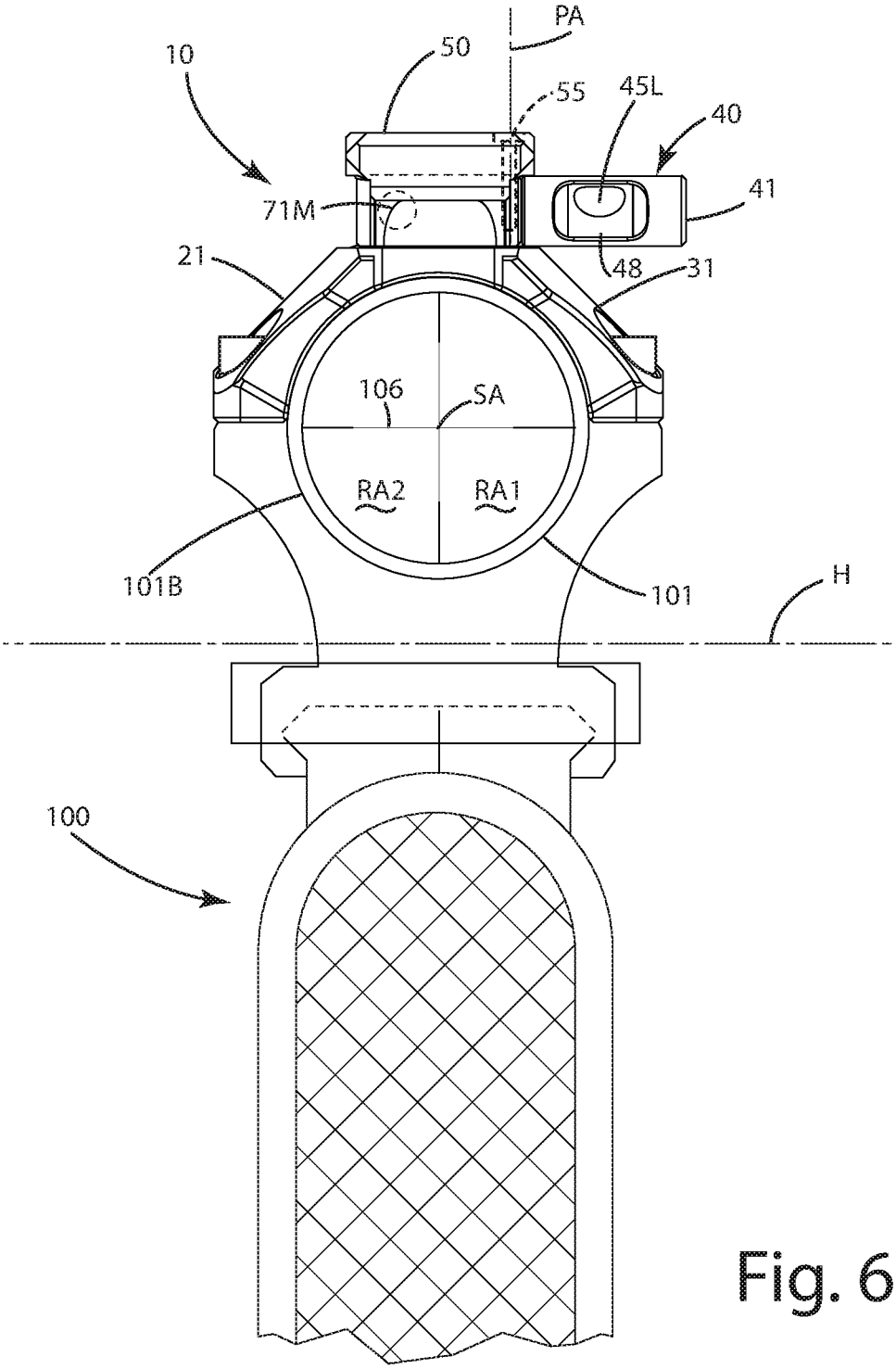
FIG. 6 is a rear view of the mounting assembly on a scope on a weapon in the stored mode.

The secondary recess 72 can be sized and shaped to receive the fixed end 41 of the level indicator 40 when the level indicator is in an extended mode as shown in FIGS. 5 and 6. The secondary recess can also include a second magnet 72M that is secured in or associated with the secondary recess in a fixed manner. The magnet can be glued, adhered, fastened, press fit or otherwise dispose in or adjacent the secondary recess. This magnet can cooperate with a fourth magnet 44M to secure the level indicator in an extended mode as described below. The secondary recess can generally be disposed transverse to the mount recess. The secondary recess also can be disposed below the rail 50 and above the mount upper surface 31BU, optionally in the upright wall 24 of the scope mount 21. The secondary recess can be disposed adjacent a pivot screw or pin or axle 55 about which the level indicator can rotate. The pin 55 can be located rearward of the secondary recess (closer to the user when in use) so that the level indicator can pivot rearward and forward of the pin. When rotated rearward of the pin, the level indicator 40 can rotate into the mount recess 70. When rotated forward of the pin, the level indicator 40 can rotate into the secondary recess as described below.

The mount recess 70 optionally can include a first magnet 71M that is disposed in or associated with that recess. The first magnet 71M can be distal from the second magnet 72M in the secondary recess 72. The first magnet 71M can be disposed on the second side RA2 of the reference axis RA, and generally closer to the second lateral side 32 of the scope mount, while the second magnet 72M can be disposed on the first side RA1 of the reference axis RA, and generally closer to the first lateral side 31 of the scope mount. These magnets can be fixed and immovable relative to the scope mount after the mount is assembled. These magnets optionally can be oriented transverse to one another. For example, the first magnet 71M can be oriented so that its central axis is parallel to the reference axis. The second magnet 72M can be oriented so that its central axis is perpendicular to the reference axis, and perpendicular to the central axis of the first magnet 71M. The central axis of the secondary magnet 72M also can face or project laterally outward from the lateral side 31 of the scope mount on one side of the reference axis. As described below, these first and second magnets can work with other magnets associated with the level indicator 40.

Optionally, each of the magnets can be a type of magnet capable of exerting a magnetic force or field on another magnet or iron containing or metal element to magnetically urge the same toward the magnet, thereby securing a component, such as the level indicator in a particular orientation and/or location. The magnets shown can be of a circular shape and small size, but the shape and size can be modified depending on the application. The magnets shown optionally can be of different types, for example, but not limited to, neodymium iron boron magnets, samarium cobalt magnets, aluminum nickel cobalt magnets and/or ferrite magnets. In some cases, one magnet can be paired with an iron or metal containing element so that the magnet can exert a magnetic force, also considered a magnetic field herein, on the element. In that case, the other element can also be considered a magnet, even though by itself it cannot exert a notable magnetic field or force.

Turning now to FIGS. 1-6, the level indicator 40 will now be described in more detail. Generally, the level indicator 40 is rotatably joined with the scope mount and includes a level indicator longitudinal axis LA. The level indicator 40 is rotatable from a stored mode, in which the level indicator longitudinal axis LA is transverse to the reference axis RA (FIGS. 1-3), to an extended mode, in which the level indicator longitudinal axis LA is transverse to the reference axis RA, and the level indicator 40 projects laterally away from the reference axis RA (FIGS. 4-6). A user U rearward of the scope mounting assembly 10 can view the level indicator extending laterally from the scope mount when the level indicator is in the extended mode, as shown in FIG. 1. In some applications, where the scope cap 21C optionally is installed in a reverse configuration, with the level indicator 40 in the stored more facing rearward toward a user U, the user rearward of the scope mounting assembly also can view the level indicator in the stored mode.

The level indicator as shown in FIGS. 2-3 can include a free end 41 and a fixed end 42 disposed at opposite ends of the indicator 40. The fixed end 42 can be secured to the scope mount 20 via the pin or axle 55 such that the level indicator 40 is rotatable about a pivot axis PA. The pin or axle 55 itself can extend through the recess 70 and the level indicator in the fixed end 42 of the indicator. The fixed end can define a bore 55B (FIG. 4) through which the pin projects. The bore can be offset from the level indicator axis LA, for example forward of the axis LA when the level indicator is in the stored mode. The bore 55B can be rearward of the axis when the level indicator is in the extended mode. The bore 55B can be laterally offset from the respective windows defined by the level indicator 40 as described below when in the stored mode.

The free end 41 optionally is not mechanically secured to the scope mount, so that it can move about the pivot axis PA in an arcuate, rounded or other pathway, when the level indicator is moved from the stored mode to the extended mode or vice versa. The free end 41 can be disposed in the mount recess 70 when the level indicator is in the stored mode. The free end 41 can be disposed adjacent a lateral side 32 of the scope mount when the level indicator is in the stored mode as shown in FIG. 2. Optionally, the free end 41 can be distal from the lateral side 32 and can project away from the lateral side 31 of the scope mount, opposite the side 32, when the level indicator 40 is in the extended mode shown in FIG. 5.

The level indicator 40 optionally can be of a tubular shape, extending from the free end 41 to the fixed end 42, as shown in FIG. 4. The tubular shape can contain a level 45 having a level indicia and one or more magnets, such as a third magnet 43M and a fourth magnet 44M. The level 45 can be a bubble level with a level element or indicia 45L that can indicate a level or horizontal condition when the indicia is aligned or oriented in a particular configuration. For example, when the indicia is a bubble and it is aligned with or between visible lines, that can indicate a horizontal orientation, such as when the indicia and level indicator in general is horizontal and/or aligned perfectly with the horizon H. In turn, this can inform the user of the cant of the weapon so corrections can be made if that would be helpful. The level indicator optionally can include a level sensor with indicia in the form or a display that can be displayed to the user U to indicate the orientation and/or angle of the level indicator and thus cant of the weapon relative to the horizon H. Other types of levels and their indicia can be substituted for the bubble level or electronic level depending on the application.

The level indicator can include a first window 48 that faces rearward when the level indicator is in the stored mode in FIGS. 3-4. The level indicator can include a second window 47 that faces forward when the level indicator is in the stored mode. Optionally, the first window 48 can face forward, away from the user U when the level indicator 40 is in the extended mode, and the second window 47 can face rearward, toward the user when the level indicator is in the extended mode, as shown in FIGS. 5-6. A user U, rearward of the scope mount and/or scope itself, can view the indicator through that second window 47 in the extended mode. This viewing can occur when the user U is holding and/or aiming the weapon in a manner so that the scope and mounting assembly are forward of the user. Optionally, the first and second windows can be combined as a single window that extends from front to rear of the level indicator, for example, over the top and/or under the bottom of the same. Further optionally, if the scope cap 21C is reversed in orientation on the base 21B, such that the second window faces rearward toward a user in the stored mode, the user can view the level indicator in both the stored mode and the extended mode.

As mentioned above, and shown in FIGS. 2, 4 and 5, the level indicator 40 can include the third magnet 43M and the fourth magnet 44M in the respective ends. The scope mount can include the first magnet 71M and second magnet 72M. The first magnet 71M can be joined with the scope mount and can be configured to magnetically secure the level indicator 40 in the stored mode, shown in FIGS. 1-3. The second magnet 72M can be joined with the scope mount and configured to magnetically secure the level indicator in the extended mode, shown in FIGS. 5-6. More particularly, the third magnet 43M and first magnet 71M can be magnetically urged toward one another, via their respective magnetic fields and/or a magnetic force in at least one of them, to magnetically secure the level indicator in the stored mode. The fourth magnet 44M and the second magnet 72M can be magnetically urged toward one another, via their respective magnetic fields and/or a magnetic force in at least one of them, to magnetically secure the level indicator in the extended mode. Optionally, the second magnet, or some combination of magnets and elements under magnetic attractions, can hold the level indicator in the extended mode under recoil from the weapon, which optionally can be greater than 4 foot pounds, greater than 5 foot pounds, greater than 6 foot pounds, greater than 7 foot pounds, greater than 8 foot pounds, greater than 9 foot pounds, greater than 10 foot pounds, greater than 15 foot pounds or greater than 20 foot pounds. Thus, the magnetic forces of the magnet interaction on the level indicator can hold the level indicator in the extended mode even under these recoils, so that a user need not replace or move again the level indicator to the extended mode after taking a shot with the weapon.

It will be appreciated that the current embodiment showing in the figures illustrates a level indicator that can be extended to the extended mode and can project laterally from the right side of the assembly 10, from the first side RA1 of the reference axis. In other constructions, the assembly 10 can be constructed so that the level indicator extends from the opposite side RA2 of the reference axis RA, for example, from the left side of the assembly and weapon. The assembly can also be modified to include pivot pins and associated magnets on either side of the reference axis, so that a user can customize the swing of the level indicator to the left or to the right by moving the pin to a hole on the left or right side of the scope mount 21.

In use, the scope mounting assembly can be used to check and correct undesired cant in the weapon, for example, in cases where the reticle 106 of the scope 101 is not aligned horizontally with the horizon H, shown in FIGS. 1, 3 and 6. The user U can check cant with the scope mounting assembly 10 by visually reviewing the level indicator 40 and its indicia 45. In the stored mode of the level indicator shown there, the respective first and third magnets hold the indicator in this position under the magnetic forces. The user also can view any secondary sight 105 associated with the scope mounting assembly 10, and use that sight if helpful, in the stored mode of the level indicator.

When the weapon is to be used in other shooting activities, the user can deploy the level indicator to the extended mode. The user U can rotate the level indicator in direction N about the pivot axis PA shown in FIG. 2, from the stored mode shown there to the extended mode shown in FIGS. 5 and 6. The user U can overcome the magnetic forces between the first 71M and third 43M magnets in so doing to rotate the level indicator to the extended mode. In so doing, the free end 41 exits the recess 70. The window 47 swaps positions with the window 48. The fixed end 42 rotates about the pin 55. When the end 42 and its magnet 43M get close enough to the magnet 72M, the magnetic forces between them close the gap and secure the level indicator in the extended mode as shown. The forces are sufficient to hold that level indicator in that mode even under the recoils noted herein. The user U can view the indicia 45 off the level indicator through the window and determine whether the reticle, scope and weapon are canted, and can thus take any helpful corrective action to reorient the weapon and scope. After the weapon is used, and it is no longer helpful for the level indicator to be in the extended mode, the user can return it to the stored mode, where the first and third magnets can hold it securely until another deployment to the extended mode.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to" or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law, including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

The invention claimed is:

1. A mounting assembly for a scope comprising;

a scope mount configured to extend adjacent and secure a scope to a weapon, the scope mount including a scope recess sized to accommodate a portion of the scope in an orientation, the scope mount including a reference axis that is generally parallel to a length of the weapon when the scope mount is installed relative to the weapon;

a level indicator mounted to the scope mount, the level indicator including a level indicator longitudinal axis, the level indicator including a first viewing window and a second viewing window through which an indicia is selectively viewable, the level indicator rotatable from a stored mode, in which the level indicator is disposed in a mount recess defined by the scope mount, to an extended mode, in which the level indicator is at least partially removed from the mount recess and the indicia is viewable by the user rearward of the scope mount through the second viewing window, and the level indicator longitudinal axis is transverse to the reference axis, and the level indicator projects laterally away from the reference axis;

a first magnet joined with the scope mount and configured to magnetically secure the level indicator in the stored mode; and a second magnet joined with the scope mount and configured to magnetically secure the level indicator in the extended mode, whereby the second magnet is configured to hold the level indicator in the extended mode under recoil from the weapon where the recoil is greater than 5 foot pounds.

2. The mounting assembly of claim 1, wherein the level indicator includes a fixed end and a free end, wherein the fixed end is secured to the scope mount via a pin such that the level indicator is rotatable about a pivot axis, wherein the free end is not mechanically secured to the scope mount.

3. The mounting assembly of claim 2, wherein the free end is disposed in the mount recess when the level indicator is in the stored mode.

4. The mounting assembly of claim 1, wherein the scope recess is a curved recess approximating an exterior surface of a cylindrical scope barrel.

5. The mounting assembly of claim 2, wherein the scope mount is a scope ring cap, wherein the scope recess is defined by an underside of the scope ring cap, wherein the scope ring cap defines a first fastener hole and a second fastener hole on opposing sides of the scope recess, whereby the first fastener hole and the second fastener hole are configured to receive first and second fasteners to secure the scope ring cap to a scope ring base.

6. The mounting assembly of claim 1, wherein the level indicator includes a free end that is disposed in the mount recess when the level indicator is in the stored mode, wherein the free end is adjacent a first side of the scope mount when the level indicator is in the stored mode, wherein the free end is distal from the first side and projects away from a second side, opposite the first side, when the level indicator is in the extended mode.

7. The mounting assembly of claim 1, comprising:

an upright wall extending upward from an upper portion of the scope mount; and a rail mounted atop the upright wall and above the scope mount, wherein the mount recess is defined between the upper portion and the rail.

8. The mounting assembly of claim 7, wherein the rail defines a plurality of slots extending perpendicular to the reference axis.

9. A mounting assembly for a scope comprising;

a scope mount configured to extend adjacent and secure a scope to a weapon, the scope mount including a scope recess sized to accommodate a portion of the scope in an orientation, the scope mount including a reference axis that is generally parallel to a length of the weapon when the scope mount is installed relative to the weapon;

a level indicator mounted to the scope mount, the level indicator including a level indicator longitudinal axis, the level indicator including a first viewing window and a second viewing window through which an indicia is selectively viewable, the level indicator rotatable from a stored mode, in which the level indicator is disposed in a mount recess defined by the scope mount, to an extended mode, in which the level indicator is at least partially removed from the mount recess and the indicia is viewable by the user rearward of the scope mount through the second viewing window, and the level indicator longitudinal axis is transverse to the reference axis, and the level indicator projects laterally away from the reference axis;

a first magnet joined with the scope mount;

a second magnet joined with the scope mount distal from the first magnet;

a third magnet joined with a free end of the level indicator; and a fourth magnet joined with a fixed end of the level indicator.

10. The mounting assembly of claim 9, wherein the third magnet and first magnet are magnetically urged toward one another to magnetically secure the level indicator in the stored mode, and wherein the fourth magnet and the second magnet are magnetically urged toward one another to magnetically secure the level indicator in the extended mode.

11. A mounting assembly comprising:

a scope mount having a scope recess configured to receive a portion of a scope, the scope mount including a reference axis and a mount recess bounded by a wall;

a level indicator rotatably joined with the scope mount and including a level indicator longitudinal axis; and a secondary optic mount disposed above the level indicator and joined with the scope mount, wherein the secondary optic mount is configured to mount a reflex or red dot sight above the scope, wherein the level indicator is rotatable from a stored mode, in which the level indicator is disposed in the mount recess adjacent the wall, to an extended mode, in which the level indicator longitudinal axis is transverse to the reference axis, oriented away from the wall, and the level indicator projects laterally away from the reference axis, whereby a user rearward of the scope mounting assembly can view the level indicator extending laterally from the scope mount when the level indicator is in the extended mode.

12. A mounting assembly comprising:

a scope mount having a scope recess configured to receive a portion of a scope, the scope mount including a reference axis and a mount recess bounded by a wall;

a level indicator rotatably joined with the scope mount and including a level indicator longitudinal axis;

a first magnet joined with the scope mount and configured to magnetically secure the level indicator in the stored mode; and a second magnet joined with the scope mount and configured to magnetically secure the level indicator in the extended mode, whereby the second magnet is configured to hold the level indicator in the extended mode under recoil from the weapon where the recoil is greater than 5 foot pounds, wherein the level indicator is rotatable from a stored mode, in which the level indicator is disposed in the mount recess adjacent the wall, to an extended mode, in which the level indicator longitudinal axis is transverse to the reference axis, oriented away from the wall, and the level indicator projects laterally away from the reference axis, whereby a user rearward of the scope mounting assembly can view the level indicator extending laterally from the scope mount when the level indicator is in the extended mode.

13. A mounting assembly comprising:

a scope mount having a scope recess configured to receive a portion of a scope, the scope mount including a reference axis and a mount recess bounded by a wall; and a level indicator rotatably joined with the scope mount and including a level indicator longitudinal axis, wherein the mount recess is disposed above and transverse to the reference axis, wherein the level indicator is secured with a magnetic force in the mount recess when the level indicator is in the stored mode, wherein the level indicator is rotatable from a stored mode, in which the level indicator is disposed in the mount recess adjacent the wall, to an extended mode, in which the level indicator longitudinal axis is transverse to the reference axis, oriented away from the wall, and the level indicator projects laterally away from the reference axis, whereby a user rearward of the scope mounting assembly can view the level indicator extending laterally from the scope mount when the level indicator is in the extended mode.

14. The mounting assembly of claim 11, wherein the level indicator includes a first window that faces rearward when the level indicator is in the stored mode, wherein the level indicator includes a second window that faces forward when the level indicator is in the stored mode, wherein the first window faces forward when the level indicator is in the extended mode, wherein the second window faces rearward when the level indicator is in the extended mode, so that the user rearward of the scope mount can view the indicator.

15. The mounting assembly of claim 11, wherein the wall extends between the scope mount and the secondary optic mount, wherein a mount recess is bounded by the scope mount, the secondary optic mount and the wall, wherein the level indicator is disposed in the mount recess when the level indicator is in the stored mode.

16. The mounting assembly of claim 11, comprising:

a pin extending through the mount recess and through the level indicator, wherein the level indicator is rotatable about the pin.

17. A mounting assembly comprising:

a scope mount having a scope recess configured to receive a portion of a scope, the scope mount including a reference axis and a mount recess bounded by a wall;

a level indicator rotatably joined with the scope mount and including a level indicator longitudinal axis;

a first magnet joined with the scope mount;

a second magnet joined with the scope mount distal from the first magnet;

a third magnet joined with a free end of the level indicator; and a fourth magnet joined with a fixed end of the level indicator, wherein the level indicator is rotatable from a stored mode, in which the level indicator is disposed in the mount recess adjacent the wall, to an extended mode, in which the level indicator longitudinal axis is transverse to the reference axis, oriented away from the wall, and the level indicator projects laterally away from the reference axis, whereby a user rearward of the scope mounting assembly can view the level indicator extending laterally from the scope mount when the level indicator is in the extended mode.

18. A mounting assembly for a scope comprising;

a scope mount configured to extend adjacent and secure a scope to a weapon, the scope mount including a downwardly opening, curved scope recess sized to accommodate a scope, the scope mount including a reference axis, the scope mount defining a mount recess disposed above the scope recess;

a level indicator rotatably joined with the scope mount, the level indicator including a level indicator longitudinal axis, the level indicator rotatable from a stored mode, in which the level indicator is disposed in the mount recess, to an extended mode, in which the level indicator is at least partially removed from the mount recess and the level indicator longitudinal axis is transverse to the reference axis, and the level indicator projects laterally away from the reference axis;

a secondary optic mount disposed above the level indicator and joined with the scope mount;

a first magnet joined with the scope mount and configured to magnetically secure the level indicator in the stored mode; and a second magnet joined with the scope mount distal from the first magnet and configured to magnetically secure the level indicator in the extended mode.

19. A mounting assembly comprising:

a scope mount having a scope recess configured to receive a portion of a scope, the scope mount including a reference axis and a mount recess bounded by a wall; and a level indicator rotatably joined with the scope mount and including a level indicator longitudinal axis, the level indicator rotatable about a vertical pivot axis in a substantially horizontal plane;

wherein the level indicator is rotatable from a stored mode, in which the level indicator is disposed in the mount recess adjacent the wall, to an extended mode, within the substantially horizontal plane, in which the level indicator longitudinal axis is transverse to the reference axis, oriented away from the wall, and the level indicator projects laterally away from the reference axis, but remains in the substantially horizontal plane, whereby a user rearward of the scope mounting assembly can view the level indicator extending laterally from the scope mount when the level indicator is in the extended mode in the substantially horizontal plane when the scope mounting assembly is leveled to reduce cant.

* * * * *